US010661952B2

(12) United States Patent
Coffey et al.

(10) Patent No.: US 10,661,952 B2
(45) **Date of Patent: *May 26, 2020**

(54) END CLOSURE WITH VENTING

(71) Applicant: SNSTech, LLC, Austin, TX (US)

(72) Inventors: Brendan Coffey, Austin, TX (US); Jefferson Blake West, Austin, TX (US); Corbett Schoenfelt, West Lake Hills, TX (US); Zackary Hickman, Austin, TX (US)

(73) Assignee: SNSTech, LLC, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/533,644

(22) Filed: Aug. 6, 2019

(65) Prior Publication Data

US 2020/0095035 A1 Mar. 26, 2020

Related U.S. Application Data

(60) Provisional application No. 62/715,118, filed on Aug. 6, 2018, provisional application No. 62/778,054, filed on Dec. 11, 2018.

(51) Int. Cl.
*B65D 51/18* (2006.01)
*B65D 51/20* (2006.01)
(Continued)

(52) U.S. Cl.
CPC ..... *B65D 51/1683* (2013.01); *B65D 17/4012* (2018.01); *B65D 17/4014* (2018.01);
(Continued)

(58) Field of Classification Search
CPC ..... A47G 19/2205; B65D 17/4014; B65D 17/4012; B65D 17/401; B65D 43/20;
(Continued)

(56) References Cited

U.S. PATENT DOCUMENTS 2,346,134 A * 4/1944 Kirkland ..... B65D 5/723 222/557
3,379,333 A * 4/1968 Navia ..... B65D 17/4012 220/267

(Continued)

FOREIGN PATENT DOCUMENTS

EP 1247752 A1 10/2002
WO WO 2008-051099 A1 5/2008

OTHER PUBLICATIONS

International Seach Report and Written Opinion dated Nov. 22, 2019, in corresponding international application No. PCT/US2019/045369.

*Primary Examiner* — Gideon R Weinerth
(74) *Attorney, Agent, or Firm* — DuBois, Bryant & Campbell, LLP; William D. Wiese

(57) ABSTRACT

An easy-opening end closure that may also be reclosed, suitable for joining to a container. A cover panel is bonded around its perimeter to an end panel with a rotatable lever interposed between them. To open the closure, a user applies force to the rotating lever to move it axially around an attachment point and thereby progressively debonding a substantial portion of the bond perimeter. The closure incorporates means for equilibrating pressure in the internal headspace of the container with the outside ambient for improved pouring.

20 Claims, 17 Drawing Sheets

(51) Int. Cl.

| | |
|---|---|
| ***B65D 17/34*** | (2006.01) |
| ***B65D 51/16*** | (2006.01) |
| *B65D 47/26* | (2006.01) |
| *B65D 17/28* | (2006.01) |

(52) U.S. Cl.
CPC ..... *B65D 47/265* (2013.01); *B65D 51/1688* (2013.01); *B65D 2517/0025* (2013.01); *B65D 2517/0034* (2013.01); *B65D 2517/0046* (2013.01); *B65D 2543/00046* (2013.01)

(58) Field of Classification Search
CPC ..... B65D 43/18; B65D 47/26; B65D 47/265; B65D 47/261; B65D 51/1688; B65D 2517/002; B65D 2517/0025; B65D 2517/0034; B65D 2517/0046; B65D 2517/0014; B65D 2517/0044; B65D 2517/0041; B65D 2517/0062; B65D 2543/00046; B65D 2543/00092; B65D 51/1683; B65D 47/32; B65D 2205/02
USPC ..... 220/367.1, 254.9, 820, 821, 253, 906, 220/258.4, 258.5, 214, 254.4; 222/83, 222/516, 556, 557, 548
See application file for complete search history.

(56) References Cited

U.S. PATENT DOCUMENTS

| | | | | |
|---|---|---|---|---|
| 4,598,837 | A | 7/1986 | Kreiseder et al. | |
| 5,248,053 | A * | 9/1993 | Lundgren | B65D 17/165 220/269 |
| 6,158,608 | A * | 12/2000 | Schlattl | B65D 17/4014 220/253 |
| 9,517,866 | B2 | 12/2016 | Coffey et al. | |
| 2002/0108954 | A1* | 8/2002 | Cho | B65D 17/4012 220/269 |
| 2009/0057315 | A1* | 3/2009 | Stringfield | B65D 17/4012 220/273 |
| 2010/0219187 | A1* | 9/2010 | Na | B65D 17/4012 220/269 |
| 2013/0292381 | A1* | 11/2013 | Chen | B65D 43/0212 220/254.4 |
| 2015/0225138 | A1* | 8/2015 | Harris | B65D 43/18 220/820 |
| 2015/0375910 | A1* | 12/2015 | Cohen Bissu | B65D 47/265 53/484 |
| 2016/0229598 | A1* | 8/2016 | Coffey | B65D 43/20 |
| 2018/0141702 | A1* | 5/2018 | Afshin | B65D 17/4014 |
| 2018/0339548 | A1* | 11/2018 | Madan | B65D 81/245 |
| 2019/0061996 | A1* | 2/2019 | Biasizzo | B65D 17/4014 |
| 2019/0283930 | A1* | 9/2019 | Schuver | B65D 17/4014 |

* cited by examiner

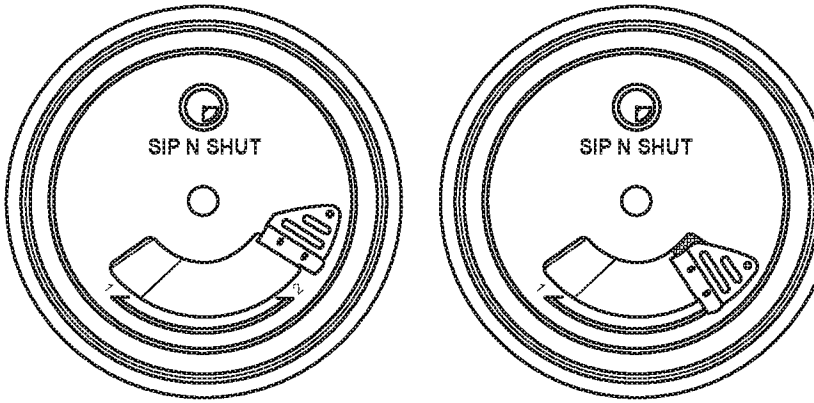
FIG. 20A
FIG. 20B
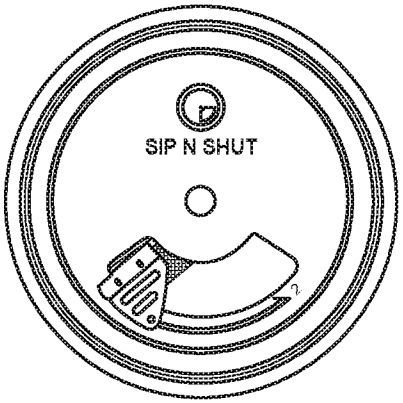
FIG. 20C
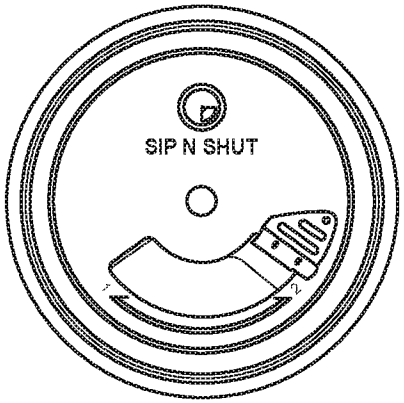
FIG. 20D

END CLOSURE WITH VENTING

PRIORITY STATEMENT UNDER 35 U.S.C. § 119 & 37 C.F.R. § 1.78

This non-provisional application claims priority based upon prior U.S. Provisional Patent Application Ser. No. 62/715,118 filed Aug. 6, 2018 in the name of Brendan Coffey, Michael DeRossi, Jefferson Blake West, Corbett Schoenfelt, Zackary Hickman, and Matthew C. Grossman entitled "Package Closure Systems," and U.S. Provisional Patent Application Ser. No. 62/778,054 filed Dec. 11, 2018 in the name of Brendan Coffey entitled "Package Closure Design," the disclosures of each of which are incorporated herein in their entirety by reference as if fully set forth herein.

BACKGROUND

"Stay on Tab" (SOT) closures for cans are a ubiquitous form of easy opening packaging for pressurized beverage containers. With SOT closure systems, as described, for example, in U.S. Pat. No. 3,731,836, a scored line in the metal container end panel is used to create a weakened boundary to which leverage can be applied via a rivet-retained tab to push an opening area through the end panel. Both the tab and the opened flap remain affixed to the end panel after opening.

Numerous patented improvements have been made to the components of the SOT closure over decades of commercial use to improve its functionality, reliability, and cost. Yet, one of the inherent limitations of the SOT solution is that it does not lend itself to reclosing since the score line break deforms the freed panel in a way that is not readily reversed. Reclosing provides added convenience to consumers of reduced spillage or reduced contamination of contents after the container has been opened.

Improved closures that provide for reversibly reclosing of a sealed container are known in the art. For example, issued U.S. Pat. No. 9,517,866 which shares at least one inventor in common with the present application, describes forms of an easy opening closure suitable for use in metal beverage containers and other forms of sealed packaging with technology related to the present invention, which provides a facile opening mechanism, as well as means for reclosing the package.

SUMMARY OF THE INVENTION

Various embodiments of the present invention pertain to a closure for a container, wherein the container has a substantially planar end panel with an aperture therethrough. Within the perimeter of the end panel is a separate and movable interior panel with an extended edge or flange area that covers the aperture and overlaps the boundary around it, the interior panel being initially fixed in place, sealed, and bonded to the end panel, and a moveable tool used to facilitate easy opening and progressive debonding of the interior panel from the end panel, thereby rendering it moveable in relation to the end panel. In certain embodiments, the interior panel may also reclose and either partially or entirely seal the aperture.

Various embodiments of the present invention pertain to aluminum easy-opening end closures that may also be reclosed, and that are suitable for joining to a beverage can in conventional double seaming operations. The interior panel, alternatively referred to as the shutter herein may be bonded around its perimeter to the end panel by heat-sealing, and the moveable tool may be in the form of a rotatable lever interposed between them. To open the closure, a user applies force to the rotating lever to move it axially around an attachment point to progressively debond a substantial portion of the bond perimeter, and then bring it into latched engagement with the shutter.

Various embodiments of the present invention are further directed to improved methods and systems for: more efficient mechanisms for debonding of the shutter, from the end panel; more robust structures for latching of the shutter to the rotatable lever; venting systems that provide for smoother pouring characteristics, and other enhancements to the overall user experience of the closure. The configuration and use of the presently preferred embodiments are discussed in detail below.

The foregoing has outlined rather broadly certain aspects of the present invention in order that the detailed description of the invention that follows may better be understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. Accordingly, the specific embodiments discussed are merely illustrative of specific ways to make and use the invention, and do not limit the scope of the invention.

As will be understood by those skilled in the art, appropriate design parameters, materials selections, and methods must be used to assure the precise and reliable operation of the closure system in the context of a particular application. While many of the example embodiments herein describe the closure in the context of a beverage can application, the innovation can be adopted to other package forms, for which alternative material selections and assembly methods may be more appropriate.

BRIEF DESCRIPTION OF THE DRAWINGS

For a more complete understanding of the present invention, and the advantages thereof, reference is now made to the following descriptions taken in conjunction with the accompanying drawings, in which:

FIGS. 20A, 20B, 20C, and 20D show four top views of the assembled container end closure of the foregoing embodiment of the present invention in the unopened, partially debonded, fully debonded, and opened states;

DETAILED DESCRIPTION OF THE PREFERRED EMBODIMENTS

Figure 1:
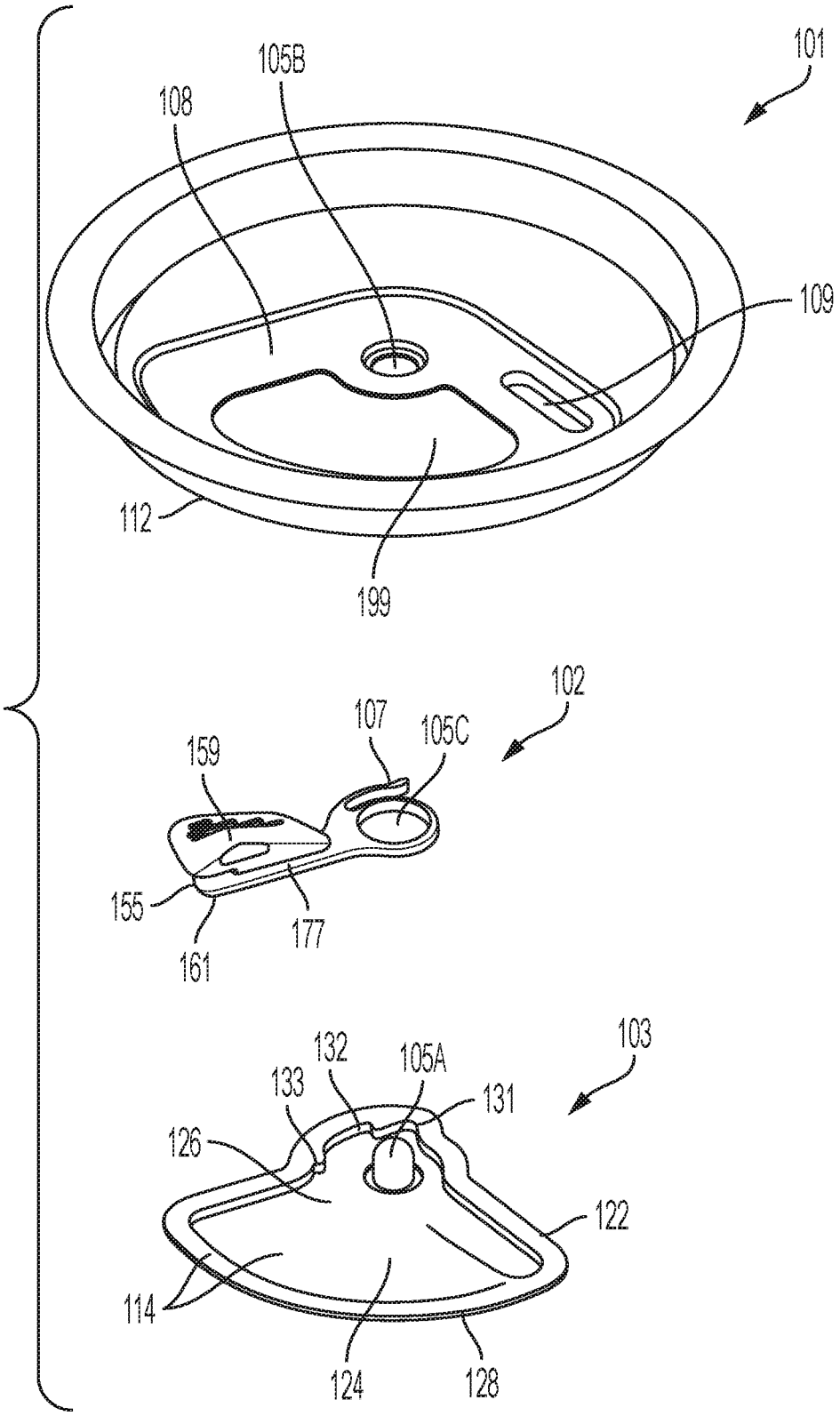
FIG. 1 shows an exploded top perspective view of one embodiment of a container end closure of the present invention.

FIG. 1 shows an exploded view, prior to assembly, of the three separate components: end panel 101, lever 102, and shutter 103 that comprise one embodiment of a container closure system. In this example, the end panel 101 is a seamable container end with a shaped aperture 199 to provide a pour spout or otherwise provide access to the container's contents. The end panel 101 also has a small through hole 105B at its center. A debossed region 108 around the aperture provides mechanical rigidity and strength to the panel in that area, and includes a further debossed anti-rotation feature 109. The lower surface 112 of the end panel 101 is pre-coated with an adherent thin layer of a suitable thermoplastic polymer. The end panel's lower surface 112 will be an interior facing boundary when assembled into a filled container.

A rotatable lever 102 is interposed between the end panel 101 and shutter 103. At its interior hub end, the lever 102 has a small through hole 105C. A formed flexible prong or pawl 107 projects radially from the side of the lever hub. The outer end of the lever 102 incorporates a formed handle 159 contoured to facilitate user grip for actuation. There is a slotted gap 155 between the lever handle 159 and the working edge 161 at the back of the lever. In the assembled closure, the circumferential edge of the end panel aperture 199 inserts into this slotted gap 155 to prevent out of plane movement of the lever end when force is applied and the lever handle 159 is rotating.

The shutter 103 is larger in area than the aperture 199. It incorporates a rivet preform structure 105A in the form of a hollow closed end cylinder that projects towards the lever 102 and end panel 101. During assembly of the closure, the columnar rivet preform structure 105A is passed through coaxial holes 105B and 105C and then collapsed down to a sealed rivet head so as to fasten the three component parts together, with its shank providing an axis of rotation for movement of the lever 102 and shutter 103.

The shutter 103 has a dished central region 126 that accommodates the lever placement and movement, and a planar flanged edge 122 around its full perimeter. The dished central region 126 is deepest near the edge rest positions at each end of the lever's travels with an intermediate tapered ramp contour 124 that provides a working fulcrum for a wedging action of the lever to debond the seal when the assembled closure is initially opened. Notches 131, 132 and 133 formed into the sidewall of the dished central region 126 generally perpendicular to its plane provide notched facets that engage with the latching pawl 107 of the lever 102. Each notch position corresponds to a specific phase of functional engagement between the lever 102 and the shutter 103 as will be further described.

Figure 2:
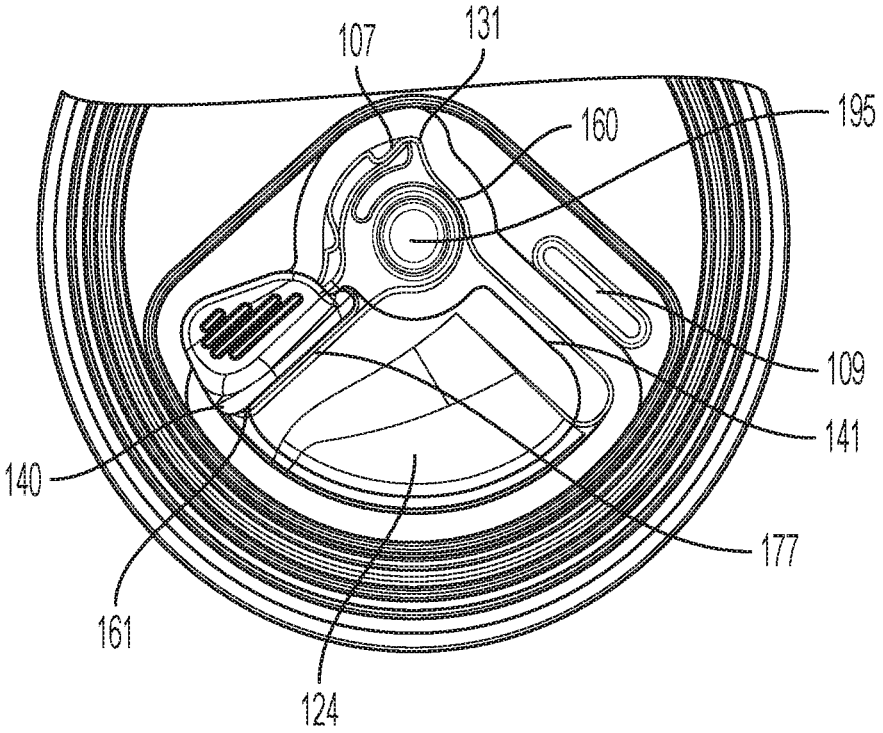
FIG. 2 shows a top view of the same embodiment of a container end closure of the present invention in the unopened state.
Figure 3:
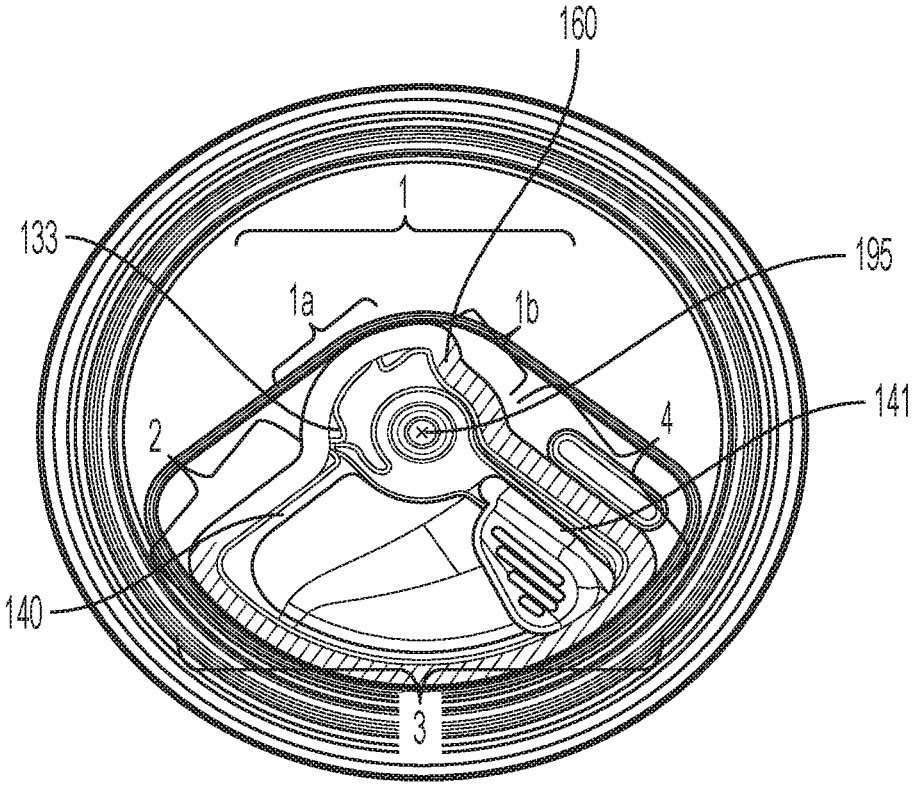
FIG. 3 shows a top view of the same embodiment of a container end closure of the present invention with demarcated regions of partial debonding.
Figure 4:
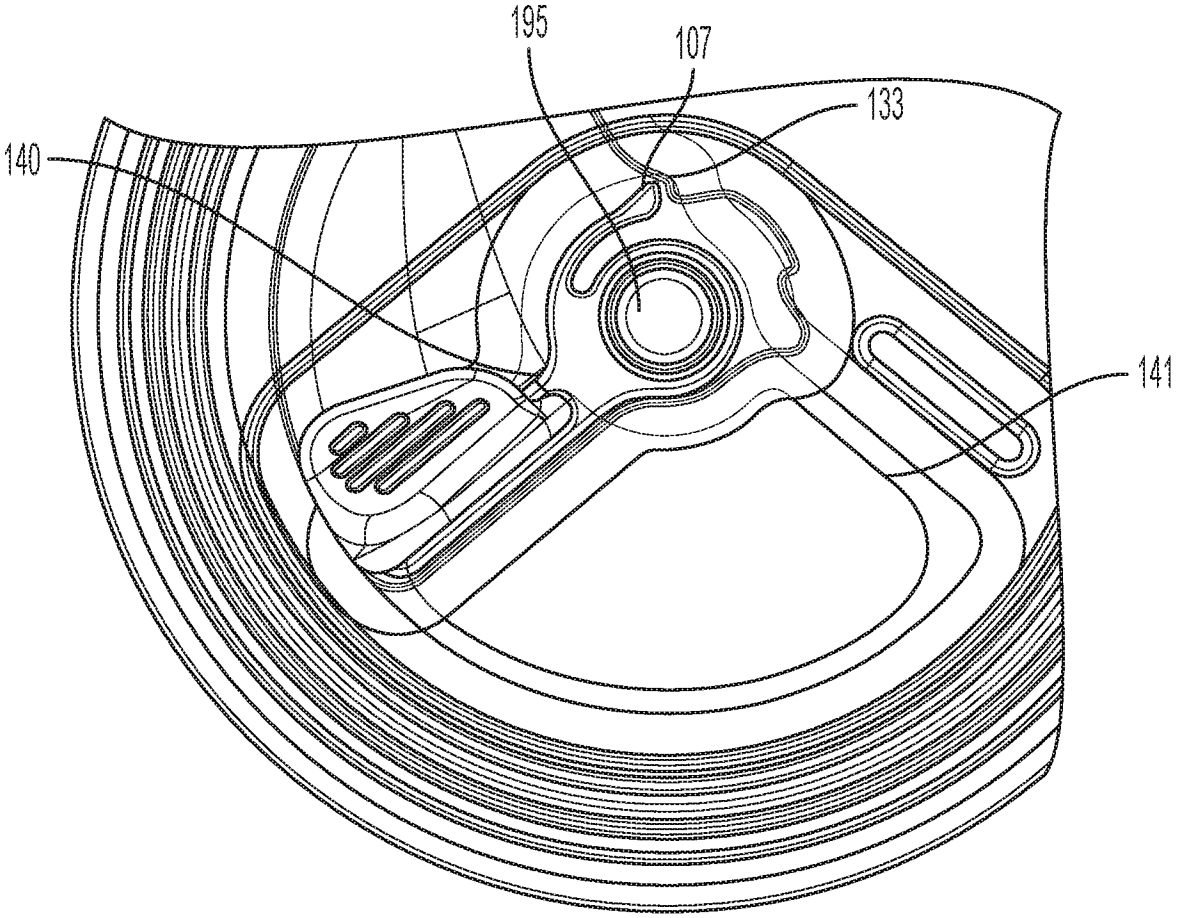
FIG. 4 shows a top view of the same embodiment of a container closure end of the present invention in the opened state.

The flat upper surface of the perimeter shutter flange 122 allows uniform close contact with the lower surface 112 of the end panel 101. In some embodiments, the entire upper surface 114 of the shutter 103, including the flanged region 122 is pre-coated with an adherent thin layer of a suitable thermoplastic polymer that is compatible for thermal fusing to the thermoplastic coating on the lower surface 112 of the end panel 101. Taken together these features enable the shutter 103 and end panel 101 to be dry assembled and then readily bonded and sealed together via heat-sealing, an established and scalable manufacturing process involving the controlled application of heat and pressure. The fused adherent surface coating material between the shutter 103 and end panel 101 creates a hermetic seal throughout the dished region 126 that fully surrounds the pour aperture 199 and closure mechanism as shown in FIGS. 2, 3, and 4. The lower surface 128 of the shutter 103 will be an interior facing boundary when assembled into a filled container and may have a barrier coating applied to it.

Top views of the closure system assembled from the components of FIG. 1, in various stages of opening are shown in FIGS. 2 (unopened), 3 (partially debonded), and 4 (opened); in each case the surface of the end panel 101 is rendered transparent in order to reveal the position of the lever 102 and shutter 103 beneath it. In the assembled state, a flattened, closed rivet head 195 now binds the end panel 101, lever 102, and shutter 103 together throughout storage and use.

FIG. 2 shows the initial sealed state of the closure in which the rotating lever is adjacent to the leftmost "first edge" 140 of the aperture with the pawl 107 located in the first latch position 131. In this initial rest position, the working edge 161 of the lever 102 is interposed in a gap between the shutter 103 and the end panel 101 and shares a common plane with the bonded seal perimeter 160, however it does not contact or apply stress to the bond seal from its recessed position in the shutter 103. The right edge of the shutter 103 abuts an anti-rotation feature 109 formed into the end panel, providing a mechanical stop throughout the debonding sequence to prevent overrotation of the shutter if prematurely released.

In the present embodiment, a user initiates opening of the closure by pushing the lever handle 159 to the right to cause counterclockwise (CCW) rotation of the lever arm 177 onto and then up along the ramp contour 124. As it is so rotated, the underside of the lever arm 177 applies an increasing downward force against the surface of the ramp contour 124, since both ends of the lever 102 are effectively constrained against the underside of the end panel 101 by the rivet 195 at the interior hub end and by the working edge 161 at the back end of the lever 102.

Progressively moving the rotating tab lever from the first aperture edge 140 toward the second aperture edge 141 thereby creates a separating force to progressively cleave and debond localized regions of the joint between the end panel 101 and the cover panel 103 along the bond perimeter 160. The ramp provides mechanical advantage to reduce the force required throughout debonding to a manageably low level which for a typical user should be below 5 to 10 lbs.

As the lever 102 is rotated through the opening sequence, the flexing pawl 107 mechanically engages with notches 131, 132, 133 in the shutter 103 in a way that permits motion in only one direction. Thus, after a small partial rotation that moves the pawl 107 from its initial notch position 131 to intermediate notch position 132, the movement cannot be reversed and may serve as a visual indicator for tamper evidencing. The pawl 107 extends radially from the side of the lever hub furthest from the aperture 199. This placement allows for reduced radial dimension, a more compact seal, and greater open pour area on the on the aperture 199 side, and also allows the end panel 101 to effectively shroud the latching mechanism from user interference and environmental contamination.

Through continued applied force, the user moves the rotating lever 102 until it abuts against the opposite second edge 141 of the aperture 199 as shown in FIG. 3. At this point of travel, debonding of the shutter 103 from the end panel 101 has been achieved along some portion of the bond perimeter 160, the latching pawl 107 engages the final notch position 133, and the cover panel 103 is irreversibly affixed to the rotating lever 102. Thereafter, providing that a sufficient degree of debonding has occurred, a user moving the lever 102 clockwise (CW) back towards the first aperture edge 140, will cause the coupled cover panel to move jointly with the lever 102 to the fully opened state shown in FIG. 4. Thereafter, the lever 102 and affixed cover panel can be moved from the first aperture edge 140 to the second aperture edge 141 and back to reversibly close and open the aperture 199.

FIG. 3 includes a graphical representation of the debonding effectiveness of the present lever/ramp closure embodiment after the lever has first been moved to the second edge of the aperture. The bond perimeter 160 in FIG. 3 is shown shaded in two tones to illustrate the extent of debonding, at this intermediate stage of opening. The darker shaded region indicates the area where the bond between the shutter 103 and the end panel 101 has been fully disrupted due to separating forces imposed by the lever 102 as it moved from the first aperture edge 140 to the second aperture edge 141. Approximations of the relative surface areas of the two shaded regions show that only about 60% of the seal area is debonded in the example embodiment.

For the shutter 103 to move freely in conjunction with the lever 102, the seal perimeter 160 must be fully disrupted. While in the forgoing description of the present embodiment the lever action was not 100% efficient in achieving such debonding, it is nevertheless possible for a user to complete the full disruption of the seal by moving the lever 102 back to the first aperture edge 140, provided that the components and the latching mechanism are sufficiently robust to effectively shear all of the remaining unbonded area of the seal.

Generally, the force per unit area required to effect shearing of a bonded joint is higher than for cleaving of the bond, and may exceed the preferred force ranges. Thus, in preferred closure embodiments, the debonding efficiency of the lever 102 in moving from the first aperture edge 140 to the second aperture edge 141 will be 60% or more, so that the bond area remaining to be sheared is low and can readily be overcome by a user.

Analysis such as that shown in FIG. 3 is useful for identifying certain segment regions of the bonded perimeter to provide mechanisms for improving overall debonding efficacy. For instance, from FIG. 3 it may be noted that the example lever/ramp embodiment is wholly effective in the bracketed segment region 4 along the second edge 141 as well as substantially effective in the bracketed segment region 3 along the circumferential edge of the aperture. Improved efficacy at the bracketed segment region 3 circumference can be achieved by refining the dimensions and contours of the tapered ramp and lever to adjust the degree of mutual interference between them, with applied force requirements suitably balanced.

Alternative closure embodiments described below provide greater effectiveness debonding in the bracketed segment regions 1 around the rivet 195 than the first example embodiment just described, as well as in bracketed segment region 2 along the first aperture edge 140.

Improved efficacy is achieved in novel embodiments described herein by incorporating different forms of mechanical features on one or more of the components: lever, shutter, end panel, that interact with corresponding mechanical features on the other components to produce functional effects when the lever is rotated. The features are selected to offer mechanical advantage to a user applied force with designs refined to optimize dimensions. Two types of functional mechanism are defined as:

A "debonding mechanism" is a formed mechanical feature on the lever 102 that by design intent will produce a mechanical interaction with the end panel or the shutter as the lever is rotated, with the resultant effect of producing a localized stress in certain specific segments of the bond perimeter between the end panel 101 and the shutter 103, so as to effectuate debonding of that segment; and a "latching mechanism" is a formed mechanical feature on the lever 102 that by design intent will create a localized fastening engagement between itself and certain corresponding features on the shutter 103 as the lever 102 is rotated. This engagement may be transitional providing for phased, uni-directional movement of the lever 102 relative to the shutter 103, or more permanent as in affixing the two components at the end of the rotational sweep.

For full disruption of the complete bond perimeter, particular embodiments may incorporate a combination of debonding mechanisms involving various stress modes applied to different bond segments, for example at different stages of the opening process and different points of the shutter/end bond perimeter, the applied stress mode may be: cleaving, peeling, tension, or shearing.

Similarly, a combination of latching mechanisms may be used to provide strong, robust, and reliable latching of the shutter to the rotatable lever at various stages of debonding. The latching system should be sufficiently robust to shear any segments of bonded seal remaining when the lever sweep is complete, while binding the shutter and lever together to reversibly close and open the aperture.

Since the rivet 195 functions as both a joint and the axis of rotation for the lever 102 and shutter 103, more effective debonding of the seal in this critical area can improve the overall debonding efficiency as well as operation of the closure. In the previously described embodiment of the present invention, the end panel 101, shutter 103, and lever 102 had a generally parallel and planar aspect in proximity to the rivet 195. Relative rotation of parallel planes does not create separating forces, whereas adding mechanical features on the lever 102 head, shutter 103, or end panel 101 in the area of the rivet 195 that produce mechanical interferences when the lever 102 is rotated can have such beneficial effect.

Figure 5A:
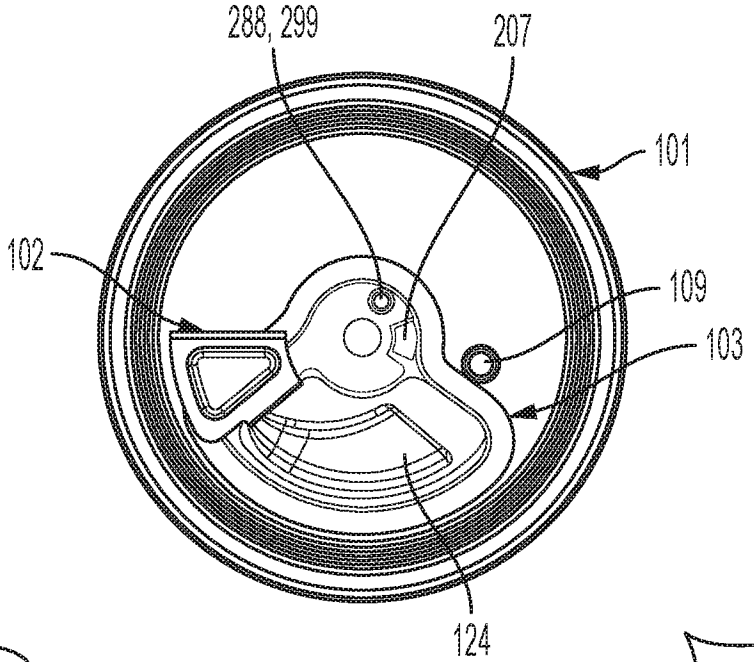
FIGS. 5A, 5B, and 5C show a series of top views of one embodiment of an assembled container end closure of the present invention in progressive stages of debonding.
Figure 5C:
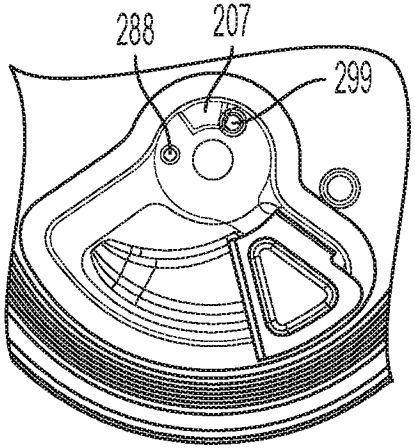
Figure 5B:
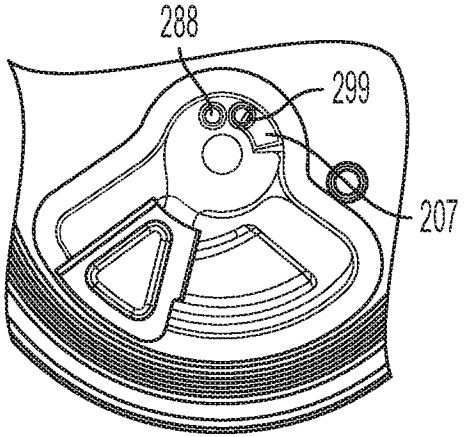
Figure 6:
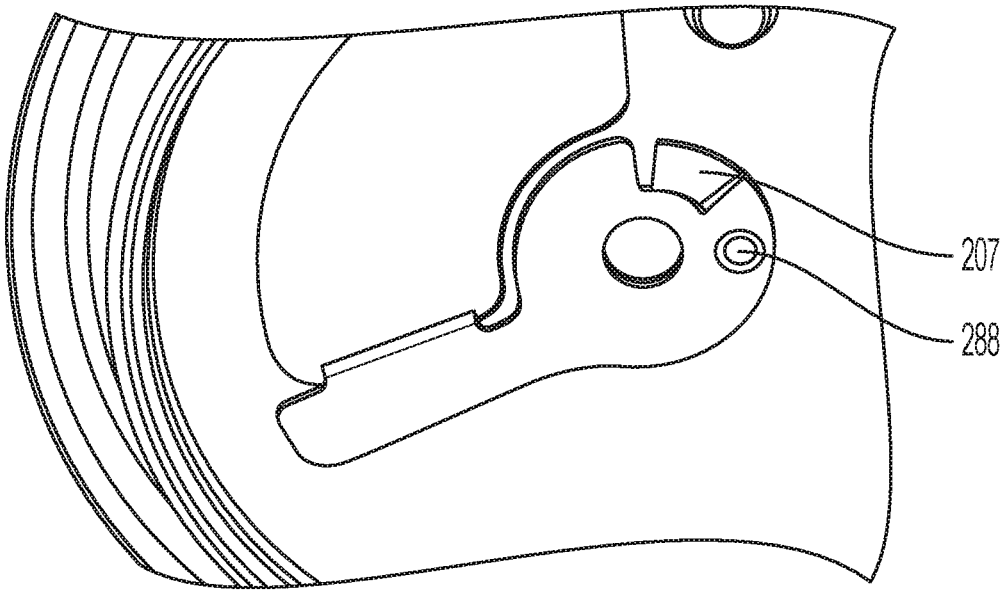
FIG. 6 shows a bottom view of the initial lever placement for the foregoing embodiment of a container end closure of the present invention in the unopened state.
Figure 7:
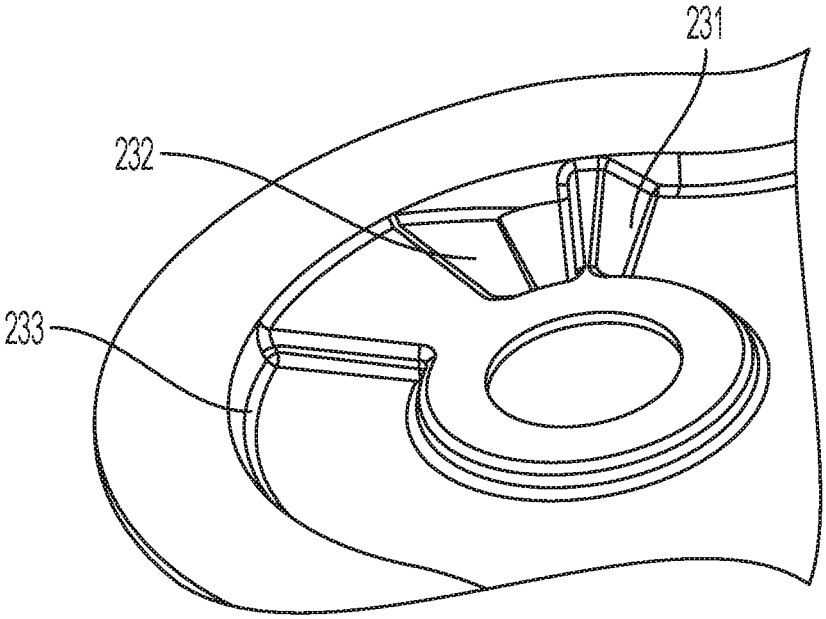
FIG. 7 shows a top view of details of stepped features in the shutter base of the foregoing embodiment of a container closure end of the present invention.

FIGS. 5 to 7 show various views of an alternative closure embodiment which shares some common elements with respect to the embodiment shown in FIG. 1 but also includes novel debonding and latching mechanisms in the seal area around the rivet and lever hub and to provide latching when a user actuates the lever.

There are again three major components: end panel 101, lever 102, and shutter 103. In some embodiments, the lower surface of the end panel 101 and the upper surface of the shutter 103 may similarly both pre-coated with an adherent thin layer of a suitable thermoplastic polymer which enables heat-sealing assembly of the closure. As before the shutter 103 incorporates an intermediate tapered ramp contour 124 that the lever acts against to effect debonding at the outer circumference and second aperture edge 141.

The rotatable lever 102 interposed between the end panel 101 and shutter 103 now has at its interior hub end a formed flexible prong or pawl 207 which, in this embodiment, projects down into the plane of the shutter 103 rather than radially. Corresponding stepped notching features 231, 232, and 233 for engagement with the latching pawl 207 are now formed into the shutter base, rather than the sidewall of the dished shutter.

Top views of the closure system in various stages of opening are shown in FIGS. 5A (unopened), 5B (partially debonded), and 5C (fully debonded); in each case the surface of the end panel 101 is rendered transparent in order to reveal the features and movement of the lever 102 and cover panel beneath it. FIG. 6 is a bottom view of the initial lever placement, and FIG. 7 shows a top detail view of stepped features formed in the shutter base around the rivet.

To increase debonding efficiency in the vicinity of the lever hub, a small rigid lever hub protrusion 288 has been formed into the lever 102 such that it projects vertically up out of the plane toward the end panel 101 in the assembled closure, which direction shall be referred to herein as the positive Z direction. FIG. 5A shows the initial sealed state of the closure, with the lever 102 positioned against the first aperture edge 140 in which condition the lever hub protrusion 288 is nested into a mating protrusion 299 formed into the end panel 101, thereby imposing no vertical mechanical stress between them. As the end panel protrusion 288 and mating protrusion 299 overlap, they are not separately distinguishable in FIG. 5A.

However, both are separately visible in FIGS. 5B and 5C which illustrate a partial and full extent CCW rotation respectively of the closure lever 102. In all views of FIG. 5, the mating protrusion 299 is static while the lever hub protrusion 288 rotates away from it with the lever 102 in a CCW direction. At points in the progression of the lever rotation where the lever hub protrusion 288 is not nested into protrusion 299, it presses against the end panel 101 creating a localized mechanical debonding stress in the seal area around the rivet. While a single pair of protrusion features is shown, multiple protrusion pairs spaced around the hub could be used to increase the swept bond perimeter. Referring back to the FIG. 3 notation, the present embodiment now has debonding efficacy in the bracketed bond segment regions around the rivet (1), at the circumferential edge of the aperture (3), and at the second aperture edge (4).

FIG. 7 shows three notching features 231, 232, 233 formed into the base of the shutter 103 that engage with the pawl 207 in various stages during opening to provide both latching and tamper evidence functionality. In the assembled closure of this alternative embodiment, the pawl 207 now projects in the negative Z direction toward the shutter 103. The latching features are covered by the lever 103 and not visible in the views of FIG. 5. In the FIG. 5A sealed closure the pawl 207 end is adjacent to notching feature 231. When the lever 102 is rotated 20 degrees CCW to the position shown in FIG. 5B, the pawl 207 engages with notching feature 232. Because the pawl 207 allows only unidirectional movement, the lever 102 cannot then be returned to its original position, and its noticeable displacement provides irreversible visual evidence of tampering with the container seal. Tamper evidencing is an important safety consideration for packaging formats that can be reclosed.

With continued CCW rotation of the lever 102 to the second aperture edge 141 as shown in FIG. 5C, the pawl 207 moves into engagement with notching feature 233 and is permanently latched to the debonded shutter 103. Moving the lever 102 back to the first aperture edge 140 shears any remnant bonded regions and fully opens the aperture 199. In this position (not shown), the lever hub protrusion 288 is again coincident and nested into the end panel mating protrusion 299 providing a hold-open detent mechanism.

Figure 9:
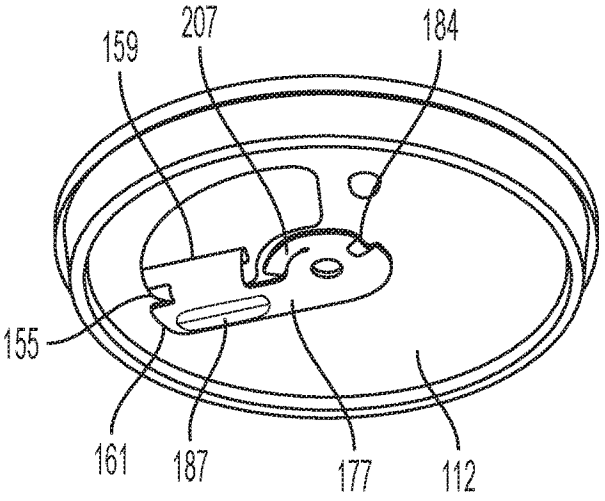
FIG. 9 shows a bottom perspective view of the initial lever placement for the foregoing embodiment of a container end closure of the present invention in the unopened state.
Figure 8:
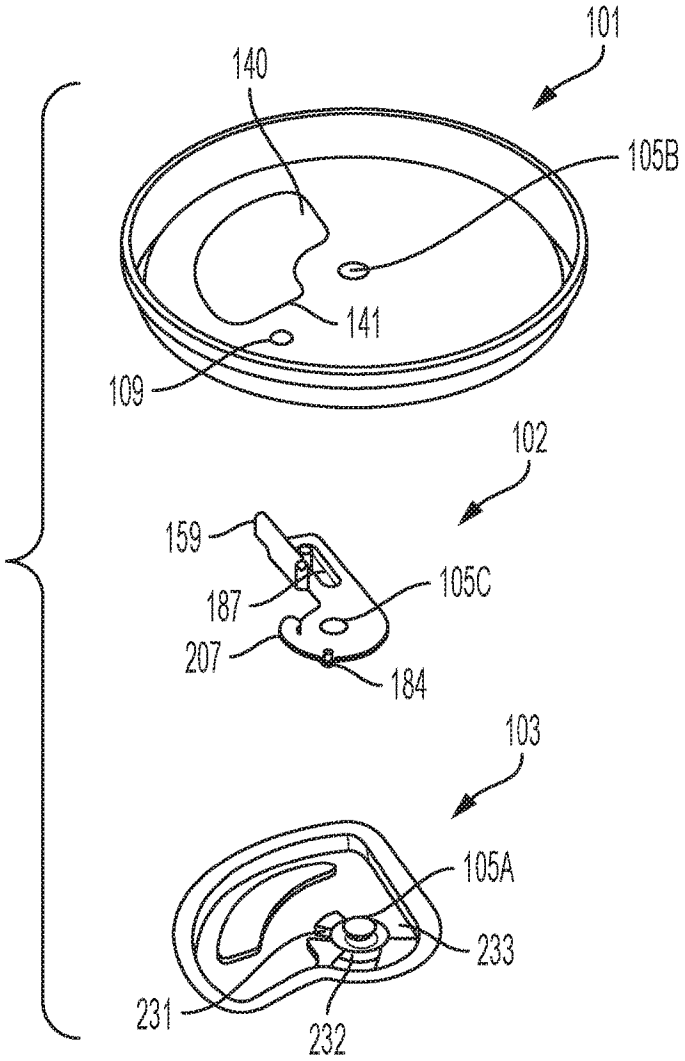
FIG. 8 shows an exploded top perspective view of another embodiment of a container end closure of the present invention.
Figure 10C:
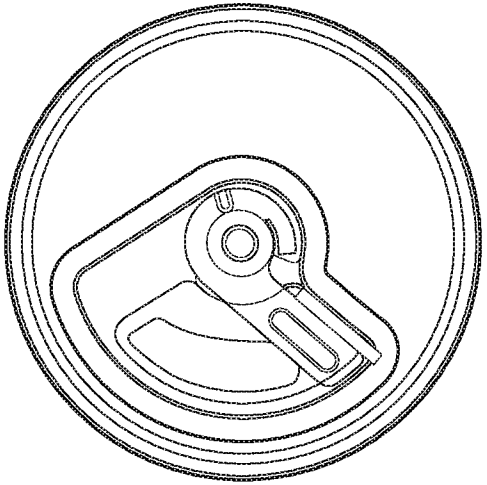
FIGS. 10A, 10B, and 10C show a series of top views of the foregoing embodiment of an assembled container end closure of the present invention in progressive stages of debonding.
Figure 10B:
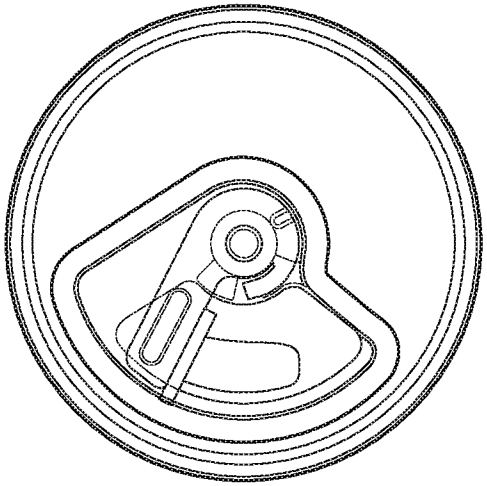

FIGS. 8 to 10 show various views of an alternative closure embodiment similar to the FIG. 5 embodiment but with certain modifications to improve the debonding and latching efficacy of the rotatable lever 102, which again has at its interior hub end, a formed flexible pawl 207 that projects down into the plane of the shutter 103 to engage with stepped notching features 231, 232, and 233 formed into the shutter base. In the initial rest position of the lever 102, the back edge of the pawl 207 is now in contact with a sharply angled wall on 231 securing it against looseness and inadvertent reverse motion.

As shown in FIGS. 8 and 9, in this embodiment the debonding mechanism is given by a downward projecting cam 184 at the lever hub rather than an upward projecting nesting protrusion. In the initial unopened position, lever cam 184 is recessed into the notching feature 232 and does not exert force. A ribbed structure 187 formed into the lever arm 177 adds stiffness providing for more forceful engagement between the lever 102 and the ramp contour 124. FIG. 9, a bottom view of the initial lever placement in the unopened state shows how the slotted gap 155 between the lever handle 159 and the working edge at the back of the lever 161 fits around the circumferential edge of the end panel aperture 199 to prevent out of plane movement of the lever end.

At points in the progression of the lever rotation where the lever hub cam is not recessed, it presses against the end panel 101 creating a localized mechanical debonding stress in the seal area around the rivet. While a single cam feature is shown, multiple cams distributed around the lever hub may be used to provide more balanced force distribution and to increase the swept bond perimeter for a given degree of rotational travel of the lever.

Figure 10A:
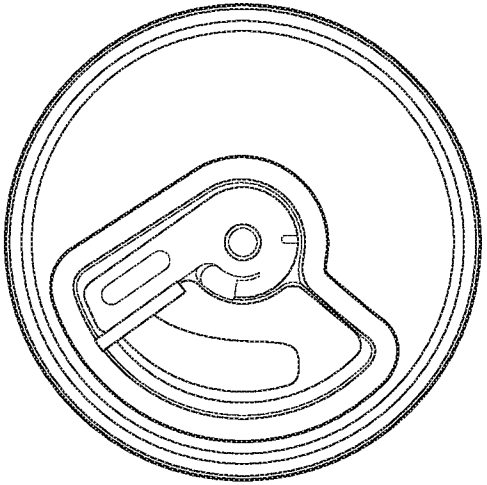

Top views of the FIG. 8 embodiment closure system in various stages of opening are shown in FIGS. 10A (unopened), 10B (partially debonded), and 10C (fully debonded); in each case the surface of the end panel 101 is rendered transparent in order to reveal the features and movement of the lever 102 and shutter 103 beneath it. Referring back to the FIG. 3 notation, the present embodiment now has debonding efficacy in the bracketed bond segment regions around the rivet (1), at the circumferential edge of the aperture (3), and at the second aperture edge (4).

In all of the foregoing example embodiments described herein, the initial position of the lever 102 was against a left-most first aperture edge 140 when the closure is viewed from above, and the debonding action of the lever 102 is achieved by counterclockwise rotation of the lever 102 toward the right-most second edge. However, the oppositely directed orientation can be equally effective. All of the subsequent embodiments described herein, have the initial position of the lever 102 against a now right-most first aperture edge 140 when the closure is viewed from above and the debonding action of the lever 102 achieved via clockwise rotation.

Figure 12A:
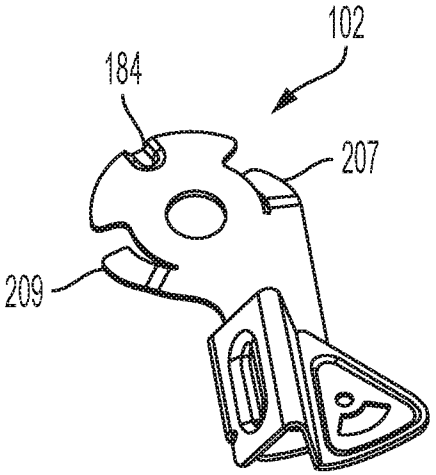
FIG. 12A shows a top perspective view and FIG. 12B an end view of the lever component of the foregoing embodiment of a container end closure of the present invention.
Figure 12B:
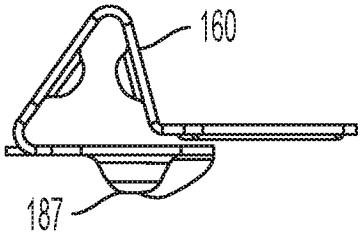
Figure 11:
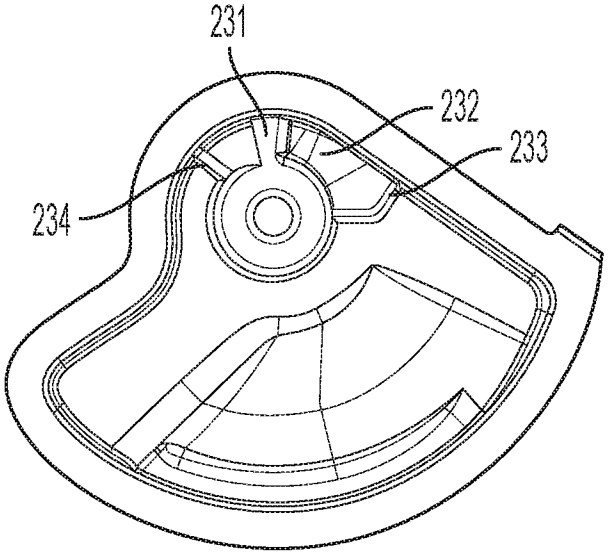
FIG. 11 shows a top view of the shutter component of another embodiment of a container end closure of the present invention.

FIGS. 11 to 13 show various views of an alternative closure embodiment similar to the FIG. 8 embodiment but with various refinements to further improve debonding and latching efficacy. As shown in FIG. 12 the rotatable lever 102 has ribbed structure 187 in the lever arm 177 and now has two flexible pawls 207, 209 that project down into the plane of the shutter to engage with stepped notching features 231, 232, 233, and 234 formed into the shutter base.

Figure 13C:
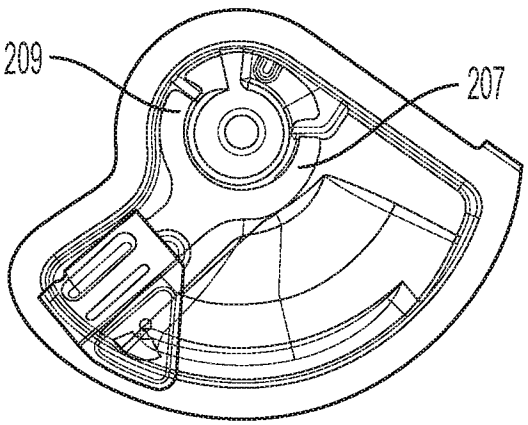
FIGS. 13A, 13B, and 13C show a series of top views of the lever and shutter components in progressive stages of debonding for the foregoing embodiment of an assembled container end closure of the present invention.
Figure 13B:
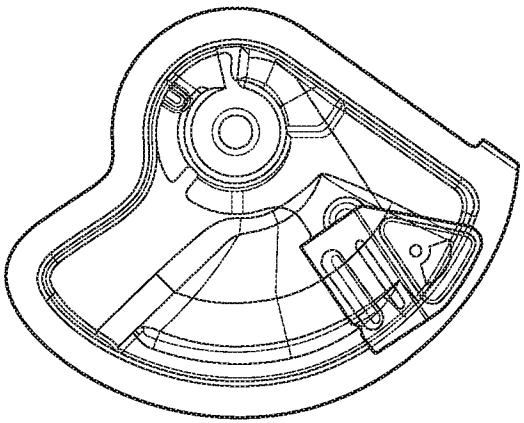
Figure 13A:
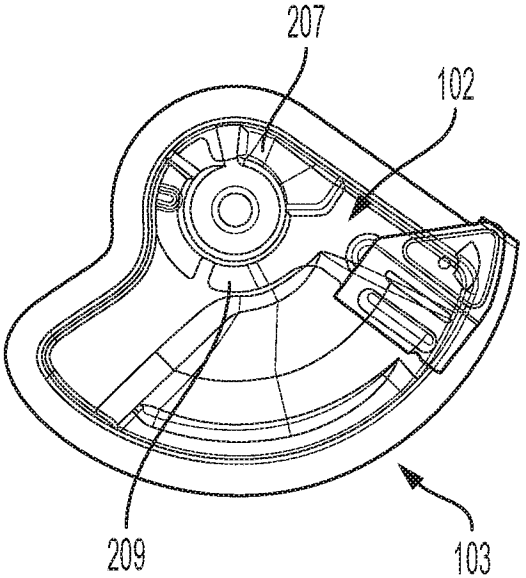

Top views of the relative positions of the lever 102 and shutter 103 of the present embodiment closure system in various stages of opening are shown in FIGS. 13A (unopened), 13B (partially debonded), and 13C (fully debonded); for clarity the end panel 101 is not shown. Debonding of this embodiment occurs via clockwise rotation of the lever 102.

Downward projecting cam 184 and ribbed structure 187 are both in recessed positions in FIG. 13A and FIG. 13C and thus neither exert separating force in the initial or final lever positions. At all other points in the progression of the lever rotation where the lever hub cam 184 and ribbed structure 187 are not recessed they press against the shutter 103 to effect mechanical debonding.

FIG. 13A shows the initial right-most rest position of the lever 102 with the back edge of pawl 207 in contact with a sharply angled wall on 231 securing it against looseness and inadvertent reverse motion. At the intermediate debonding position shown in FIG. 13B the back edge of pawl 207 is in contact with a sharply angled wall on notching feature 232 now providing irreversible tamper evidencing. At the final debonding position shown in FIG. 13C the back edge of pawl 207 is in contact with a sharply angled wall on notching feature 233 providing secure latching to prevent relative motion between the lever 102 and shutter 103 during applied CCW rotation, and the back edge of pawl 209 is in contact with a sharply angled wall on notching feature 234 providing secure latching to prevent relative motion between the lever 102 and shutter 103 during applied CW rotation. Two pawls that firmly engage shutter notches from opposite rotational directions is a form of multi-point latching that gives robust bidirectional restraint, resistant to backlash or rotation in either CW or CCW directions.

Closure embodiments that were described previously incorporated contoured ramp features formed into the surface of the shutter 103 against which a rotating lever arm acted to create a perpendicular separating force in the zone 3 circumferential bond perimeter joining the end panel 101 to the shutter 103. Continued rotation of the lever 102 thereby progressively debonded the seal between the two components in this region. In certain embodiments the seal in the area around the rivet 195 was simultaneously debonded by cams or formed protrusions on the lever hub.

Embodiments described below provide a debonding mechanism with an alternative mode of interaction between the lever 102 and the shutter 103/end panel 101 interface to create separating forces for debonding. Rather than a contoured ramp on the shutter 103, novel formed feature sets incorporated into the shutter 103 as well as the lever 102 simultaneously provide both debonding and latching mechanisms.

A "latching wedge," defined herein as a mechanical feature that can be formed onto various points on the lever, has at its leading edge (with respect to the forward direction of rotation of the lever), a narrow cross section tapered or curved form that readily enters into and moves along a gap with low resistance. The cross section of the latching wedge increases in scale from its leading edge to its trailing edge, thereby creating a wedging action in the gap. Its trailing edge has a sharply angled or barbed projection that will engender strong mechanical resistance to back rotation of the lever.

Figure 14:
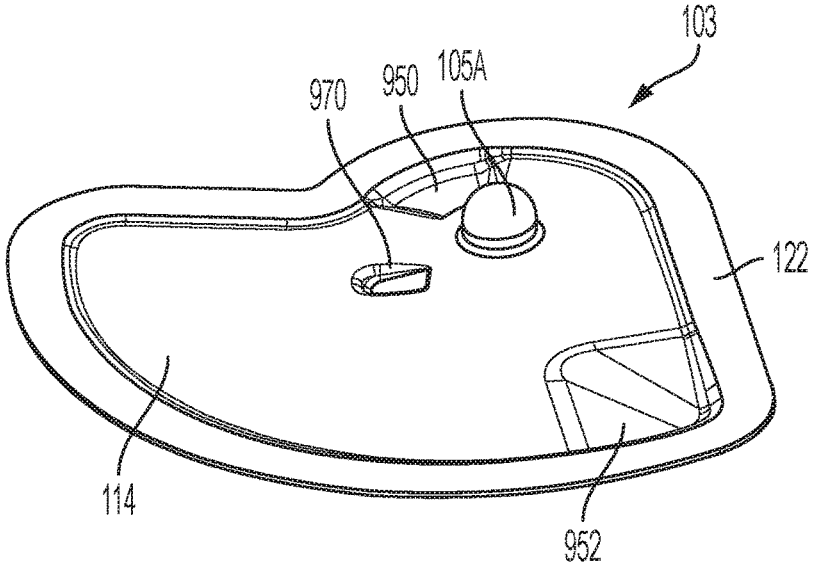
FIG. 14 shows a top perspective view of the shutter component of another embodiment of a container end closure of the present invention.

FIG. 14 illustrates a novel form of shutter panel 103 for an alternative closure embodiment. As in previous embodiments the shutter panel 103 is larger in area than the aperture 199 with a planar flanged edge around its perimeter and incorporates a rivet preform structure 105A which is collapsed to fasten it to the lever 102 and end panel 101 during assembly. However, the shutter 103 shown in FIG. 14 does not incorporate a contoured ramp in the region that the lever arm would cross and generally has a more shallow and planar dished central region to accommodate lever placement and movement. Two small, shallow, recessed pocket features 950, 952 formed into the shutter are shown.

Figure 15:
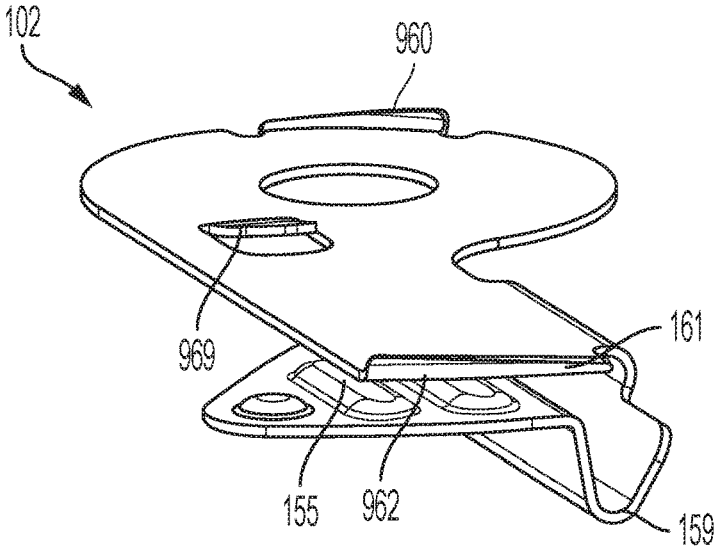
FIG. 15 shows a bottom perspective view of the lever component of the foregoing embodiment of a container end closure of the present invention.

FIG. 15 shows the underside of an alternative lever configuration 102 with a first latching wedge 960 at its hub end, a second latching wedge 962 at its tail end, and a latching pawl 969 formed into the lever arm. In the assembled closure these three features project down from the bottom of the lever 102 toward the upper surface 114 of the shutter 103. There is a slotted gap 155 between the lever handle and the working edge at the back of the lever 161. In the assembled closure this gap 155 tracks along the circumferential edge of the end panel aperture and prevents out of plane movement of the lever end when force is applied and the lever 102 is rotated.

Figure 16:
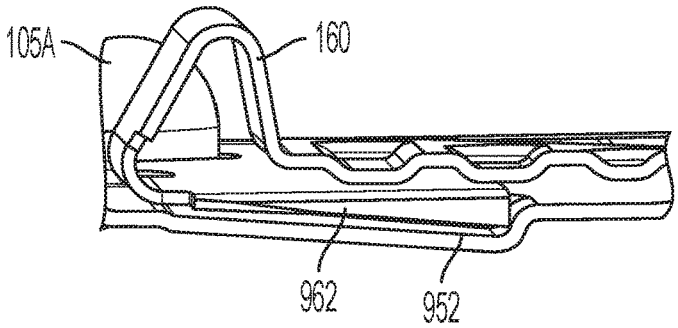
FIG. 16 shows a partial cross section view of the lever and shutter components of the foregoing embodiment of a container end closure of the present invention.

FIG. 16 is a partial cross section view of the tail end of the lever 102 showing the latching wedge 962 recessed into the ramped shutter pocket 952, reflecting the relative position of these two components in their initial rest position in a complete assembled closure. A similar recessed arrangement pertains between the latching wedge 960 and recessed pocket feature 950 structures when the lever 102 is in its initial rest position. When recessed thus into the shutter pockets the latching wedges at both working edges of the lever 102 do not contact or apply stress to the bond seal.

Figure 17A:
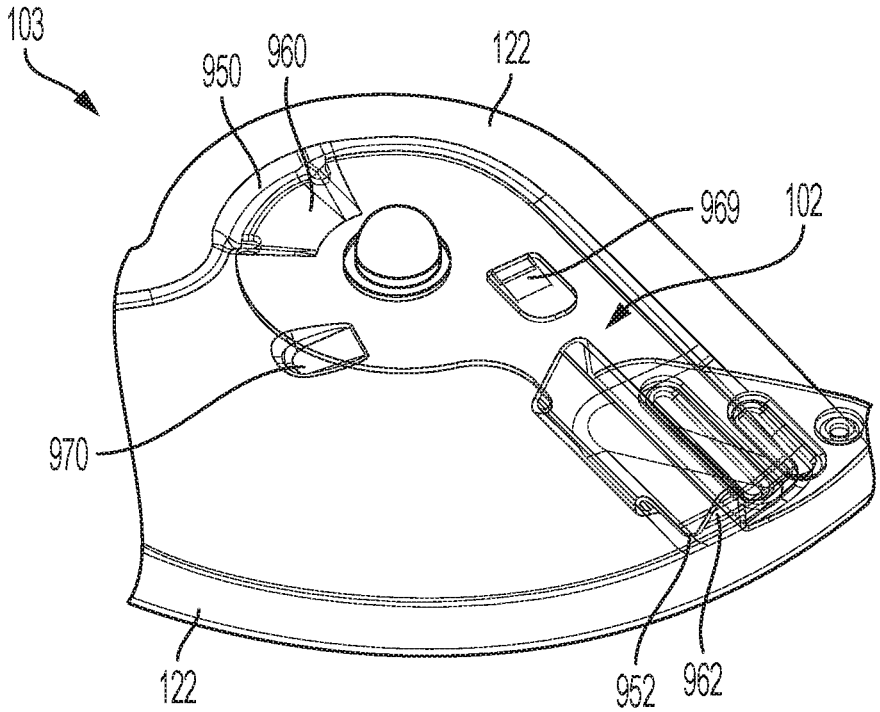
FIGS. 17A and 17B show two top perspective views of the lever and shutter components of foregoing embodiment of an assembled container end closure of the present invention in progressive stages of debonding.
Figure 17B:
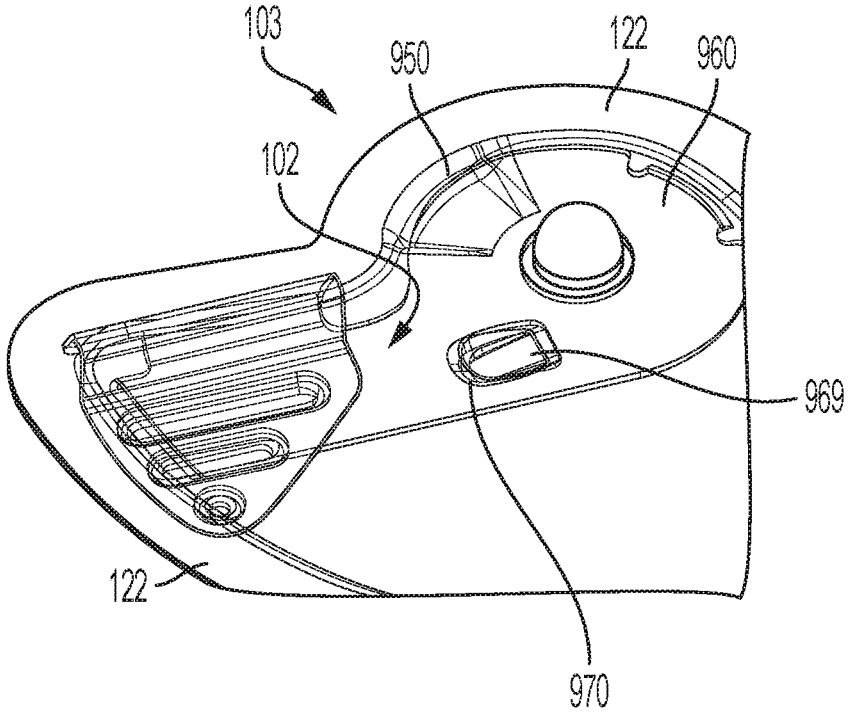

FIG. 17 show the relative positions of just the shutter and lever as they would occur in a complete closure assembly in the (17A) initial sealed and (17B) debonded positions. For visual clarity the end panel 101 is not present in FIG. 17 and the rivet preform 105A is shown unclosed. The lever 102 is initially against the now right-most first edge from which a user would rotate it in a clockwise direction. As the lever 102 moves from the FIG. 17A to the FIG. 17B position, each of the latching wedge structures 960, 962 climbs the ramped wall of their respective recessed pockets 950, 952, wedge into and then move along gaps between the shutter 103 and end panel 101. Each latching wedge provides mechanical advantage and their movement applies stress to adjacent bond perimeter to progressively effect debonding.

When the lever 102 has completed its clockwise rotation to the second aperture edge, as shown in FIG. 17B the latching pawl 969 engages mechanically with the formed pocket 970 to latch the lever 102 to the shutter 103. Both sidewalls of the pocket 970 are steeply angled and resistant to disengagement with the pawl 969 for rotation in either CW or CCW directions, giving robust bidirectional latching.

Figure 18:
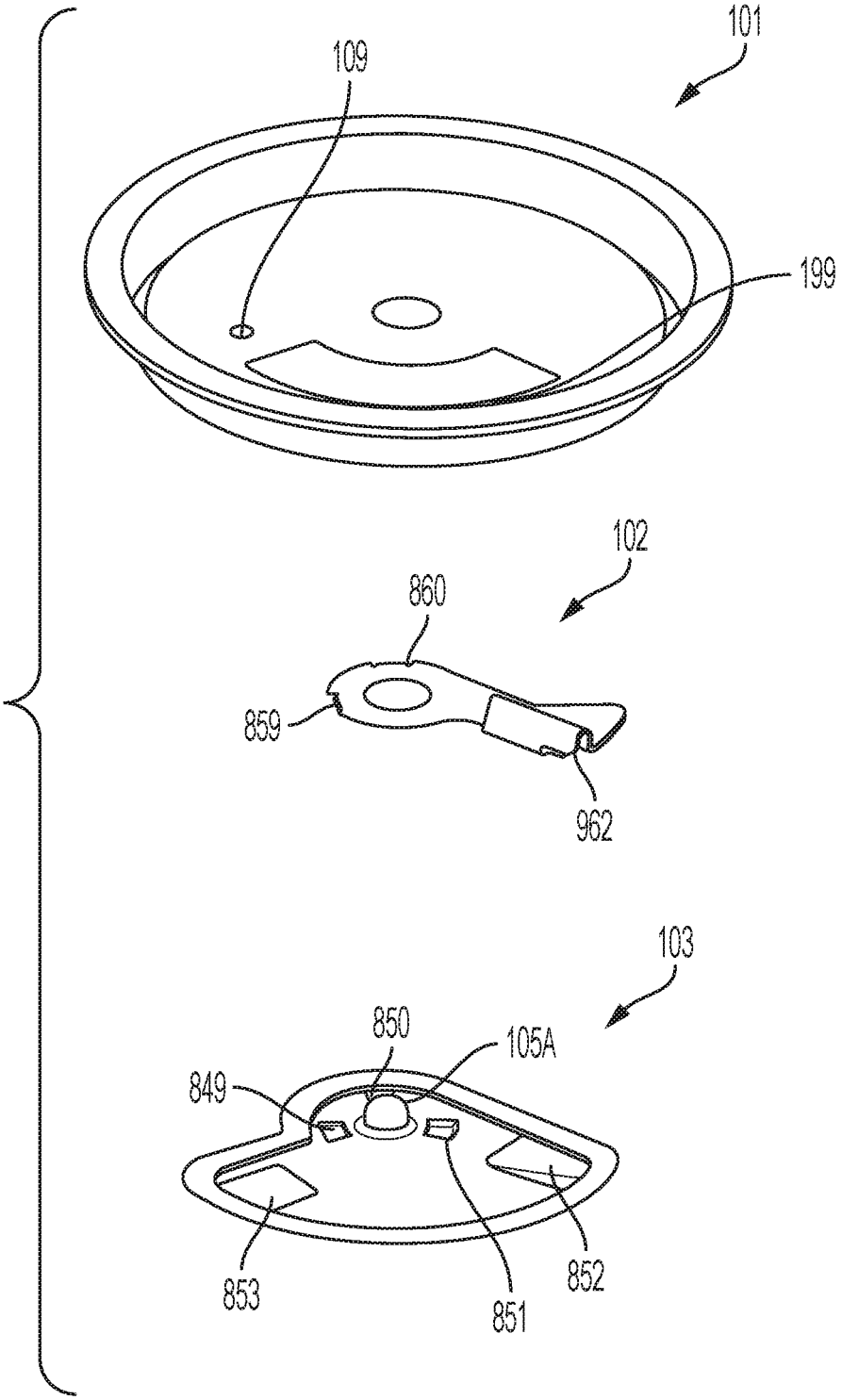
FIG. 18 shows an exploded top perspective view of another embodiment of a container end closure of the present invention.

FIGS. 18 to 20 show another example embodiment of a closure with latching wedge features at both working edges of the lever and recessed pockets in the shutter panel that house and engage with them. FIG. 18 is an exploded view of the three components: end panel 101, lever configuration 102, and shutter panel 103. The end panel 101 is a seamable container end with a shaped aperture 199 and a debossed anti-rotation feature 109. The lower surface 112 of the end panel is pre-coated with an adherent thin layer of a suitable thermoplastic polymer. A rotatable lever 102 is interposed between the end panel 101 and shutter 103. The shutter panel 103 incorporates a rivet preform structure 105A. During assembly of the closure, the columnar rivet preform structure 105A is passed through coaxial holes 105B and 105C and then collapsed down to a sealed rivet fastening the three parts together with its shank providing an axis of rotation for movement of the lever 102 and shutter 103.

The entire upper surface 114 of the shutter 103, including the flanged region 122 is pre-coated with an adherent thin layer of a suitable thermoplastic polymer that is compatible for heat sealing to the thermoplastic coating on the interior surface 112 of the end panel. The lower surface 122 of the shutter 103 may have a barrier coating applied to it.

As shown in FIGS. 18 and 19 there is a single latching wedge feature 962 at the tail of the lever 102 and now two recessed pockets 852, 853 at the circumferential perimeter of the shutter 103. At the lever hub there are now two angularly offset, latching wedge features 859, 860 along with three angularly offset pockets 849, 850, 851 in the area around the shutter rivet.

Figure 19A:
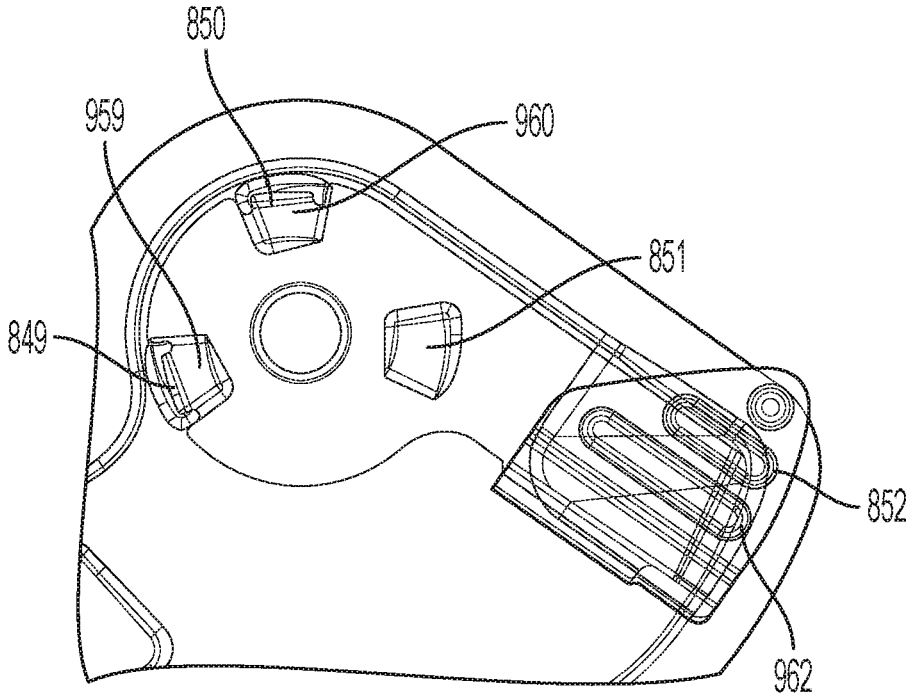
FIGS. 19A and 19B show two top views of the lever and shutter components of foregoing embodiment of an assembled container end closure of the present invention in progressive stages of debonding.
Figure 19B:
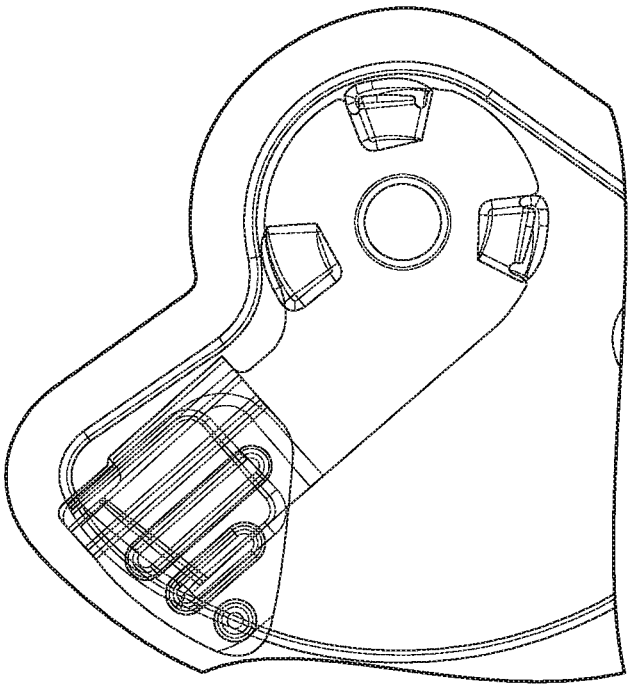

FIG. 19 shows top views showing the relative positions of just the shutter 103 and lever 102 as they would occur in a complete closure assembly in the (19A) initial sealed and (19B) debonded positions. For visual clarity the end panel 101 is not present in FIG. 19 and the rivet preform 105A is shown unclosed. The lever 102 is initially against the now right-most first edge from which a user would rotate it in a clockwise direction. As the lever 102 moves from the FIG. 19A to the FIG. 19B position, each of the latching wedge structures 859, 860, 962 climb the ramped wall of their respective initial recessed pockets 849, 850, 852, then wedge into and move along gaps between the shutter 103 and end panel 101. Each wedge provides mechanical advantage and their movement applies stress to adjacent bond perimeter to progressively effect debonding. Referring back to the FIG. 3 notation, the present embodiment now has debonding efficacy in the bracketed bond segment regions around the rivet (1), at the circumferential edge of the aperture (3), and at the second aperture edge (4).

The shutter of this current example embodiment provides recessed pockets for all shown latching wedge features on the lever at both their initial assembled rest position as well as at the end-of-travel, latched final position. When the lever has been rotated to the second aperture edge and its debonding action is complete, these end position pockets allow the latching wedges to effectively be retracted, relieving the separating force between the shutter and end panel and allowing the gap between them to reclose. Additionally, sharply inclined back walls in each end position pocket then abut the barbed trailing edge of each latching wedge. These mechanical engagements prevent reversal of rotation and provide secure, multi-point latching of the lever to the shutter.

The angular positions of the latching wedges and pockets are arranged so that the forwardmost wedge feature ends up in a previously unoccupied pocket and the trailingmost wedge feature ends up in the pocket initially occupied by the forwardmost wedge. Distributing multiple wedges around the lever hub provides for a more balanced force distribution and more complete sweeping of the bond area around the rivet for a given degree of rotational travel of the lever. A graduated, ratcheting arrangement of wedges and pockets around the rivet can be realized by increasing the number of wedges and pockets while reducing their radial width.

As a user moves the rotating lever 202 from the FIG. 19A to the FIG. 19B position, debonding of the shutter 103 from the end panel 101 is achieved along some portion of the bond perimeter 160, and the shutter 103 is irreversibly affixed to the rotating lever 102 via multi-point latching of wedges and pockets. Thereafter, moving the lever 102 counterclockwise (CCW) back towards the right-most first aperture edge will produce the open state of the closure shown in FIG. 20D, and moving the lever CW to the left-most second aperture edge will reclose the closure as shown in FIG. 20C.

FIGS. 20A-D illustrate examples of embedded user cues on closure status. For a partially opened closure of FIG. 20B, irreversible displacement of the lever position from its initial position and an exposed color indication signify a breached status to the user.

In all views of the assembled closure in FIG. 20, the end panel can be seen to effectively shroud the interior debonding and latching mechanisms from user interference and environmental contamination in all opened and closed states.

Figure 21:
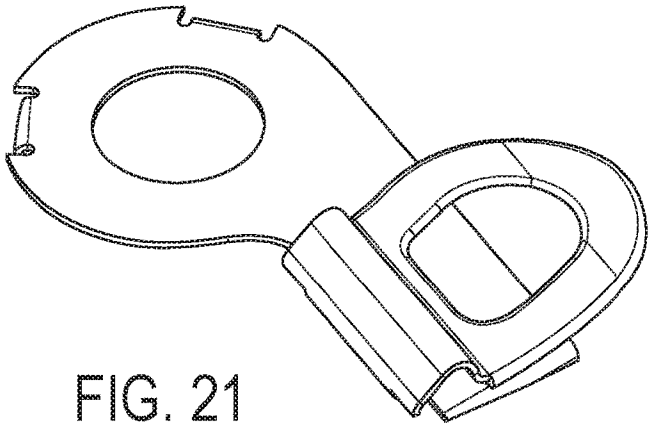
FIG. 21 is a top perspective view of an embodiment of a novel rotating lever for a container end closure of the present invention.
Figure 22B:
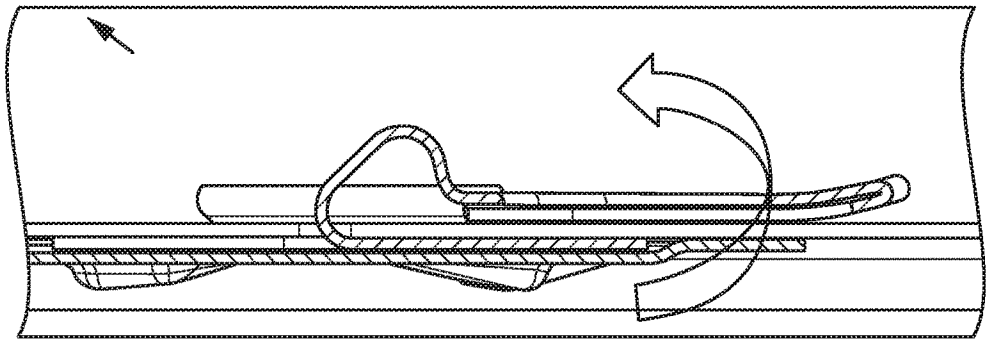
FIG. 22A is a top view, and FIG. 22B a sectional view of a novel rotating lever assembled into a container end closure of the present invention.
Figure 22A:
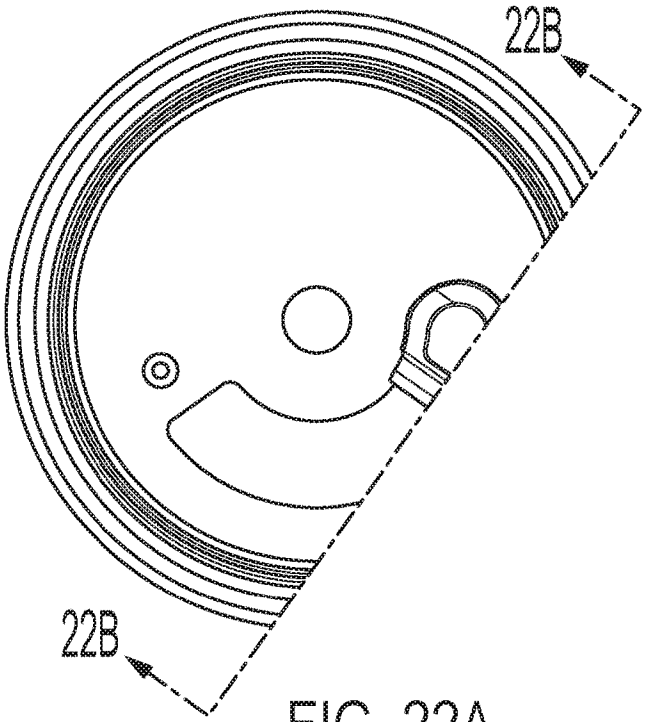

An alternative form of lever that may be implemented into the FIGS. 18-20 closure assembly embodiment is shown in FIGS. 21 and 22. The handle of this lever is in the form of a hemmed loop, a structure commonly used to add stiffness and grippability in a lay-flat structure that facilitates stacking and nesting of end closures. The modified lever additionally enables a further debonding mechanism, whereby pulling the handle up against torsion in the lever arm as shown in FIG. 20B causes a cam at its leading edge to apply tensile stress to the bond seal adjacent to the first aperture edge. Debonding in this region of the seal is then propagated by pulling on the lever handle to move latching wedges into and along gaps between the shutter and end panel.

Referring back to the FIG. 3 notation, the present embodiment now has debonding efficacy in the bracketed bond segment regions around the rivet (1), at the circumferential edge of the aperture (3), at the second aperture edge (4), and at the first aperture edge (2).

Filled metal beverage containers when sealed typically accommodate some positive internal pressure during storage, the level depending on the application. The first stage of opening a SOT closure on a filled container involves relieving any internal pressure, after which the force needed to extend the opening is reduced. For some embodiments of the current invention, the initial pressure release occurs at the location where the seal is first selectively breached by the lever's action and pressure can escape through a gap created between the shutter and end panel.

When drinking from beverage cans, consumers generally prefer that the container delivers smooth pouring at high flowrate. For the open container, another form of pressure differential bears on this characteristic of the container closure. Pouring from a beverage container aperture may be negatively impacted by limited pathways for air to enter the container and equalize reduced internal pressure in interior headspace caused by beverage outflow. Fluid surface tension blocking the aperture, combined with reduced pressure in interior headspace, inhibits steady flow of liquid resulting in a gurgling, pulsing flow.

The engineering design of the closure on a metal beverage container effects its capability to equilibrate pressure in the internal headspace of the container with the outside ambient. For conventional SOT closures, design solutions for headspace pressure equilibration include providing the largest practicable aperture size or adding supplementary scoreline vent openings in the end panel.

Various embodiments of the present invention include a novel means for creating a pressure equilibration venting channel, defined as a gap created and maintained between the opened shutter and the end panel that provides a continuous air pathway connecting external ambient pressure to interior headspaces above the fluid contents in the container for pressure equilibration of interior headspaces remote from the aperture. Various arrangements of mechanical features on the end panel, shutter, or lever may be used to create and maintain the gap between the end panel and the shutter as the latter is rotated into the open position to create the pouring aperture and simultaneously create the pressure equilibration venting channel between the outer ambient air and interior headspaces.

Figure 23B:
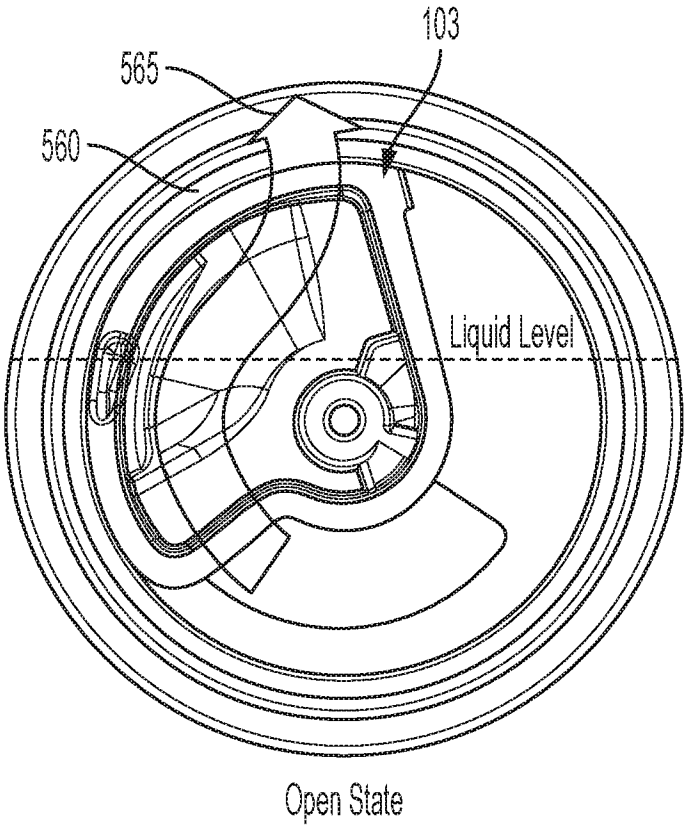
FIGS. 23A and 23B show two bottom views of an embodiment of an assembled container end closure of the present invention in closed and opened positions.
Figure 23A:
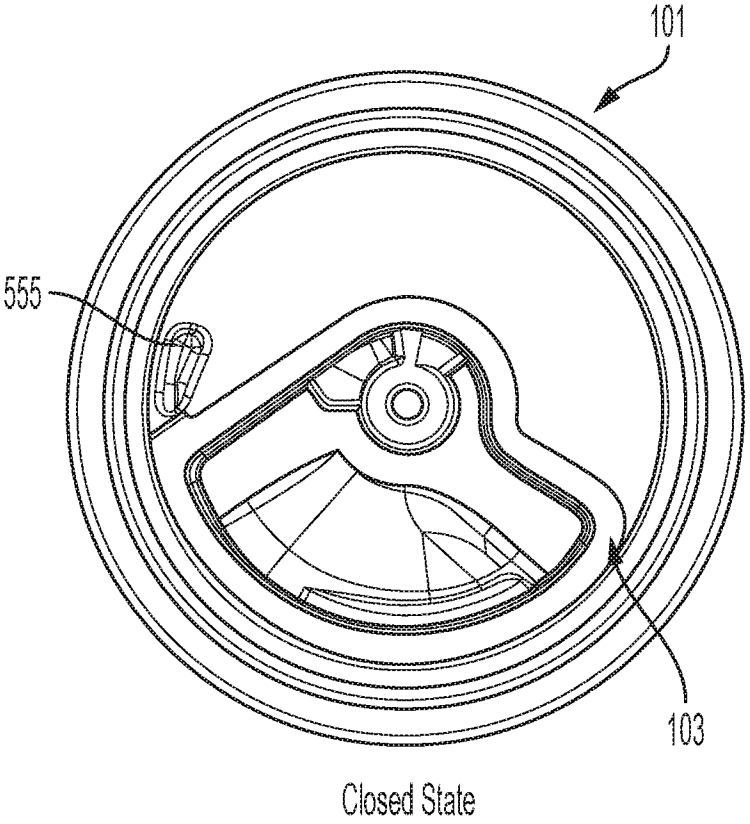

FIG. 23A shows a bottom view of an embodiment of an assembled container end closure of the present invention in the closed position with a small wedging ramp feature 555 embossed into the interior of the end panel 101.

The wedging ramp 555 is positioned so that, as the shutter is rotated back to open the aperture, it is lifted to create and maintain a gap 560 between the end panel 101 and the shutter as shown in FIG. 23B. The gap 560 extends for the full overlapping length of the end panel 101 and cover panels between the pouring aperture and the inner perimeter of the end panel 101, creating a continuous pathway 565 between external ambient air and the can interior headspace for a pressure equilibration venting channel.

A small wedging ramp 555 with a maximum height on the order of, for example, 0.060" is sufficient to pry and hold open both back and front edges of the shutter 103. The wedging ramp 555 does not interfere with debonding or latching systems; in production, this structure could be created as an embossed feature in the end panel 101.

Many alternative combinations of mechanical formations in or on the lever, shutter, and end panel may be used to provide a pressure equilibration venting channel between the opened shutter 103 and the end panel 101. For example, rather than a ramp feature to create separation, channel features might be embossed into the surfaces of the shutter 103 or end panel 101 in areas that overlap when the shutter 103 is opened.

Equilibration can thus be accomplished with a single aperture in the end panel 101 rather than a plurality of openings and separately provided vents. As the shutter 103 is rotated back off the ramp to close the aperture, the gap 560 and thus the pressure equilibration venting channel 565 is eliminated concurrently for more complete reclosing.

Figure 24B:
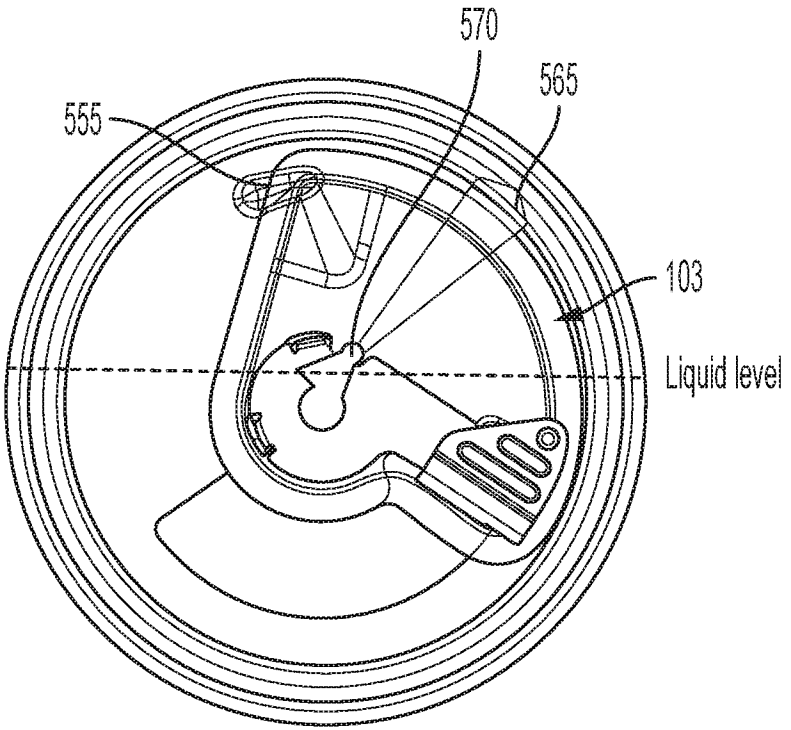
FIGS. 24A and 24B show two top views of an embodiment of an assembled container end closure of the present invention in closed and opened positions.
Figure 24A:
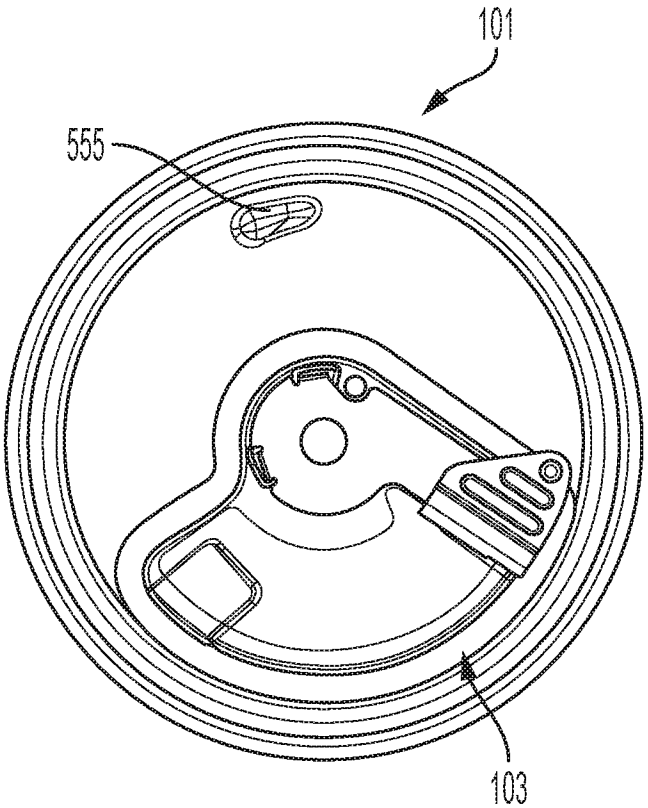

FIGS. 24A and 24B show two top views (with the end panel 101 rendered transparent) of an alternative embodiment of a pressure equilibrating closure. In this embodiment the pressure equilibration venting channel 565 connects the interior headspace to a vent hole 570 in the end panel 103 located within the sealed bond perimeter, rather than to the pour aperture.

Embodiments of the present invention provide superior means for pressure equilibration between remote interior headspace and external ambient air, enabling smooth pouring and high flow velocity per unit aperture area and time even with smaller aperture opening size.

While the present system and method has been disclosed according to the preferred embodiment of the invention, those of ordinary skill in the art will understand that other embodiments have also been enabled. Even though the foregoing discussion has focused on particular embodiments, it is understood that other configurations are contemplated. In particular, even though the expressions "in one embodiment" or "in another embodiment" are used herein, these phrases are meant to generally reference embodiment possibilities and are not intended to limit the invention to those particular embodiment configurations. These terms may reference the same or different embodiments, and unless indicated otherwise, are combinable into aggregate embodiments. The terms "a", "an" and "the" mean "one or more" unless expressly specified otherwise. The term "connected" means "communicatively connected" unless otherwise defined.

When a single embodiment is described herein, it will be readily apparent that more than one embodiment may be used in place of a single embodiment. Similarly, where more than one embodiment is described herein, it will be readily apparent that a single embodiment may be substituted for that one device.

In light of the wide variety of closure systems known in the art, the detailed embodiments are intended to be illustrative only and should not be taken as limiting the scope of the invention. Rather, what is claimed as the invention is all such modifications as may come within the spirit and scope of the following claims and equivalents thereto.

None of the description in this specification should be read as implying that any particular element, step or function is an essential element which must be included in the claim scope. The scope of the patented subject matter is defined only by the allowed claims and their equivalents. Unless explicitly recited, other aspects of the present invention as described in this specification do not limit the scope of the claims.

To aid the Patent Office and any readers of any patent issued on this application in interpreting the claims appended hereto, the applicant wishes to note that it does not intend any of the appended claims or claim elements to invoke 35 U.S.C. 112(f) unless the words "means for" or "step for" are explicitly used in the particular claim.

What is claimed is:

1. A container with a venting closure, comprising an end panel on a container, the end panel having an aperture therethrough and also having a centrally-located through hole;

a lever having a centrally-located through hole;

a shutter configured with a centrally-located attachment device configured to align with the centrally-located through hole of the lever and the centrally-located through hole of the end panel, the shutter being larger in size than the aperture and having a perimeter flange area that abuts a portion of the end panel that surrounds the aperture, the shutter being removably bonded to the end panel along the perimeter flange area;

the lever being interposed between the end panel and the shutter and being rotatable around its centrally located through hole;

wherein as the lever is rotated around its centrally located through hole, the shutter is progressively separated from the end panel thereby creating a pressure equilibration venting channel for venting the container.

2. The container with a venting closure of claim 1, wherein the pressure equilibration venting channel is created by a wedge ramp on a side of the end panel facing the shutter, the wedge ramp positioned so that, as the lever is rotated a first direction, a gap is created between the end panel and the shutter thereby providing venting for head-space of the container.

3. The container with a venting closure of claim 2, wherein as the lever is rotated in a second direction, the gap closes and, therefore, the pressure equilibration venting channel is eliminated for more complete reclosing.

4. The container with a venting closure of claim 2, wherein the wedge ramp is embossed in the end panel.

5. The container with a venting closure of claim 1, wherein the end panel is a seamable container end affixed to the container.

6. The container with a venting closure of claim 1, wherein the centrally-located attachment device is a rivet.

7. The container with a venting closure of claim 1, wherein the shutter is configured with a dished central region to accommodate the lever and its rotation.

8. The container with a venting closure of claim 1, wherein the shutter is removably bonded to the end panel along the perimeter flange area with a hermetic seal that fully surrounds the aperture.

9. The container with a venting closure of claim 1, wherein the perimeter flange area of the aperture is debossed to provide rigidity.

10. An end panel with a self-venting closure, comprising an end panel having an aperture therethrough and also having a centrally-located through hole;

a lever having a centrally-located through hole;

a shutter configured with a centrally-located attachment device configured to align with the centrally-located through hole of the lever and the centrally-located through hole of the end panel, the shutter being larger in size than the aperture and having a perimeter flange area that abuts a portion of the end panel that surrounds the aperture, the shutter being removably bonded to the end panel along the perimeter flange area;

the lever being interposed between the end panel and the shutter and being rotatable around its centrally located through hole;

wherein as the lever is rotated around its centrally located through hole, the shutter is progressively separated from the end panel thereby creating a pressure equilibration venting channel.

11. The end panel with a self-venting closure of claim 10, wherein the pressure equilibration venting channel is created by a wedge ramp on a side of the end panel facing the shutter, the wedge ramp positioned so that, as the lever is rotated a first direction, a gap is created between the end panel and the shutter.

12. The end panel with a self-venting closure of claim 11, wherein as the lever is rotated in a second direction, the gap closes and, therefore, the pressure equilibration venting channel is eliminated for more complete reclosing.

13. The end panel with a self-venting closure of claim 11, wherein the wedge ramp is embossed in the end panel.

14. The end panel with a self-venting closure of claim 10, wherein the end panel is a seamable container end.

15. The end panel with a self-venting closure of claim 10, wherein the centrally-located attachment device is a rivet.

16. The end panel with a self-venting closure of claim 10, wherein the shutter is configured with a dished central region to accommodate the lever and its rotation.

17. The end panel with a self-venting closure of claim 10, wherein the shutter is removably bonded to the end panel along the perimeter flange area with a hermetic seal that fully surrounds the aperture.

18. The end panel with a self-venting closure of claim 10, wherein the perimeter flange area of the aperture is debossed to provide rigidity.

19. An end panel with a self-venting closure, comprising an end panel having an aperture therethrough and also having a centrally-located through hole;

a lever having a centrally-located through hole;

a shutter configured with a centrally-located attachment device configured to align with the centrally-located through hole of the lever and the centrally-located through hole of the end panel, the shutter being larger in size than the aperture and having a perimeter flange area that abuts a portion of the end panel that surrounds the aperture, the shutter being removably bonded to the end panel along the perimeter flange area;

the lever being interposed between the end panel and the shutter and being rotatable around its centrally located through hole;

wherein as the lever is rotated around its centrally located through hole, the shutter is progressively separated from the end panel thereby creating a pressure equilibration venting channel; and wherein the lever is configured with a debonding mechanism such that, as the lever is rotated around its centrally-located through hole, a bond segment is progressively severed thereby rendering the shutter moveable in relation to the end panel.

20. An end panel with a self-venting closure, comprising an end panel having an aperture therethrough and also having a centrally-located through hole;

a lever having a centrally-located through hole;

a shutter configured with a centrally-located attachment device configured to align with the centrally-located through hole of the lever and the centrally-located through hole of the end panel, the shutter being larger in size than the aperture and having a perimeter flange area that abuts a portion of the end panel that surrounds the aperture, the shutter being removably bonded to the end panel along the perimeter flange area;

the lever being interposed between the end panel and the shutter and being rotatable around its centrally located through hole;

wherein as the lever is rotated around its centrally located through hole, the shutter is progressively separated from the end panel thereby creating a pressure equilibration venting channel; and wherein an edge of the lever is configured with a latching mechanism.

* * * * *